US005758789A

United States Patent [19]

Shin et al.

[11] Patent Number: 5,758,789

[45] Date of Patent: Jun. 2, 1998

[54] CARBONATED BEVERAGE BOTTLE

[76] Inventors: Woong-Sik Shin, Hyundai Apt. #116-907, Apkujung-Dong, Kangnam-Ku, Seoul; Duk-Sik Shin, 275-17, Naeduk-1-Dong, Sangdang-Ku, Cheongju, Chungcheongbuk-Do; Byung-Han Choi; Sung-Sik Shin, both of Hyundai Apt., #116-907, Apkujung-Dong, Kangnam-Ku, Seoul, all of Rep. of Korea

[21] Appl. No.: 704,436

[22] Filed: Aug. 9, 1996

[30] Foreign Application Priority Data

Jun. 19, 1996 [KR] Rep. of Korea ..... 1996/16377

[51] Int. Cl.[6] ..... B65D 21/08

[52] U.S. Cl. ..... 215/382; 215/900; 220/666

[58] Field of Search ..... 215/382, 396, 215/399, 900; 220/666, 670, 672; 222/107

[56] References Cited

U.S. PATENT DOCUMENTS

| | | | |
|---|---|---|---|
| 3,474,844 | 10/1969 | Lindstrom et al. | 220/666 |
| 3,557,788 | 1/1971 | Swartz | 220/666 X |
| 4,157,103 | 6/1979 | LaFleur | 220/666 X |
| 5,002,193 | 3/1991 | Touzani | 220/666 X |
| 5,158,123 | 10/1992 | Senko | 220/666 X |
| 5,310,068 | 5/1994 | Saghri | 220/666 X |
| 5,615,791 | 4/1997 | Vatelot et al. | 220/666 X |

*Primary Examiner*—Christopher J. McDonald

*Attorney, Agent, or Firm*—Jacobson, Price, Holman & Stern, PLLC

[57] ABSTRACT

A bottle for carbonated beverages is disclosed. The bottle almost completely prevents the dissolved carbonic dioxide from vaporizing and vanishing into carbonic acid gas when drinking the carbonated beverage sparingly, thus maintaining the cool and fresh taste of the carbonated beverage for a lengthy period of time. A bellows is formed on the bottle body and may be compressed by at least two strip fasteners, thus reducing the volume of the bottle. In order to couple the fasteners to the bottle, the bottle has at least two lock slits with respective elastic pawls and at least two passing slits with respective stop depressions. The lock slits may be formed on the neck flange of the bottle, while the passing slits may be formed on the bottle stand. Alternatively, the positions of the lock slits and the passing slits may be changed with each other. The free end portions of the strip fasteners may have a notched hook and a hook hole, respectively, which are selectively coupled together so as to form a handle for the bottle.

4 Claims, 4 Drawing Sheets

CARBONATED BEVERAGE BOTTLE

BACKGROUND OF THE INVENTION

1. Field of the Invention

The present invention relates in general to synthetic resin bottles for carbonated beverages and, more particularly, to a structural improvement in such bottles for almost completely preventing dissolved carbonic dioxide from vanishing into carbonic acid gas when drinking the carbonated beverage sparingly with the cap repeatedly opened and closed, thus maintaining the cool and fresh taste of the carbonated beverage for a lengthy period of time while sparingly partaking the carbonated beverage.

2. Description of the Prior Art

Carbonated beverages are generally classified into several types, that is, carbonated drink, carbonated water and perfumed/carbonated drink. The carbonated drink is typically produced by mixing sugars, fruit or vegetable juice, grain extract and/or various additives to carbonated potable water. The carbonated water is produced from pure water which is naturally or artificially carbonated. On the other hand, the perfumed/carbonated drink is produced by adding sugars and additives to carbonated potable water. The dissolved carbonic dioxide in the typical carbonated drink or perfumed/carbonated drink is not less than 0.05%, while that of the carbonated water is not less than 0.1%. The above carbonated beverages have highly-pressurized carbonic dioxide dissolved in water, thus giving a cool and fresh sensation to users. In recent years, carbonated beverages have been bottled in large-sized bottles, such as PET bottles of 1 or 1.5 litters, so that the users can drink the carbonated beverages sparingly. However, when the cap of a carbonated beverage bottle is repeatedly opened and closed in order to drink the beverage sparingly, the dissolved carbonic dioxide in the beverage gradually vaporizes into carbonic acid gas and thereby vanishes. The carbonic beverage remaining in the bottle thus loses its intrinsic taste as time elapses, and thereby fails to give the cool and fresh sensation to the users.

In a bottle containing carbonated beverage, the pressure inside the bottle must be higher than the atmospheric pressure in order to saturate the beverage with dissolved carbonic dioxide. When the cap of the bottle is opened in order to drink the beverage sparingly, the dissolved carbonic dioxide quickly vaporizes and vanishes into carbonic acid gas due to the high pressure inside the bottle. In addition, when pouring or drinking some quantity of beverage, the empty space inside the bottle is filled with air prior to replacing the cap on the neck in order to keep the bottle covered. The dissolved carbonic dioxide gradually vaporizes and thereby completely vanishes into carbonic acid gas, so that the carbonated beverage ultimately loses its intrinsic taste. In this regard, the typical bottle fails to maintain the cool and fresh taste of a carbonated beverage when drinking the beverage sparingly.

SUMMARY OF THE INVENTION

It is, therefore, an objective of the present invention to provide a structurally improved bottle for carbonated beverages by which the above problems can be overcome and which almost completely prevents dissolved carbonic dioxide from vaporizing and vanishing into carbonic acid gas when drinking the carbonated beverage sparingly with the cap repeatedly opened and closed, thus maintaining the cool and fresh taste of the carbonated beverage for a lengthy period of time.

In order to accomplish the above objective, a bottle for carbonated beverage according to an embodiment of the present invention includes a bellows formed partially or totally on the bottle body, and at least two lock slits formed on the annular neck flange of the bottle and spaced out at regular intervals. Each lock slit has an elastic pawl. At least two protrusions are formed on the bottle stand at positions corresponding to the lock slits. Each protrusion is depressed on its bottom to have a stop depression and is holed to have a passing slit. At least two strip fasteners are coupled to the respective lock slits and protrusions thereby selectively reducing the volume of the bottle by compressing the bellows. Each fastener has both a stop flange and a ratchet and passes upward through each protrusion and an associated lock slit in a way such that the stop flange is seated in and stopped by the stop depression of the protrusion and the ratchet engages with the elastic pawl of the lock slit.

In another embodiment, the positions of the lock slits with respective elastic pawls and the passing slits with respective stop depressions may be changed with each other. That is, the lock slits with respective elastic pawls may be formed on the bottle stand, while the passing slits with respective stop depressions may be formed on the neck flange. In this case, each fastener passes downward through each passing slit and an associated lock slit.

In a further embodiment, the free end portions of the strip fasteners have a notched male hook and a female hook hole, respectively, which are selectively coupled together so as to form a handle for the bottle.

BRIEF DESCRIPTION OF THE DRAWINGS

The above and other objectives, features and other advantages of the present invention will be more clearly understood from the following detailed description taken in conjunction with the accompanying drawings, in which.

DESCRIPTION OF THE PREFERRED EMBODIMENTS

Figure 1:
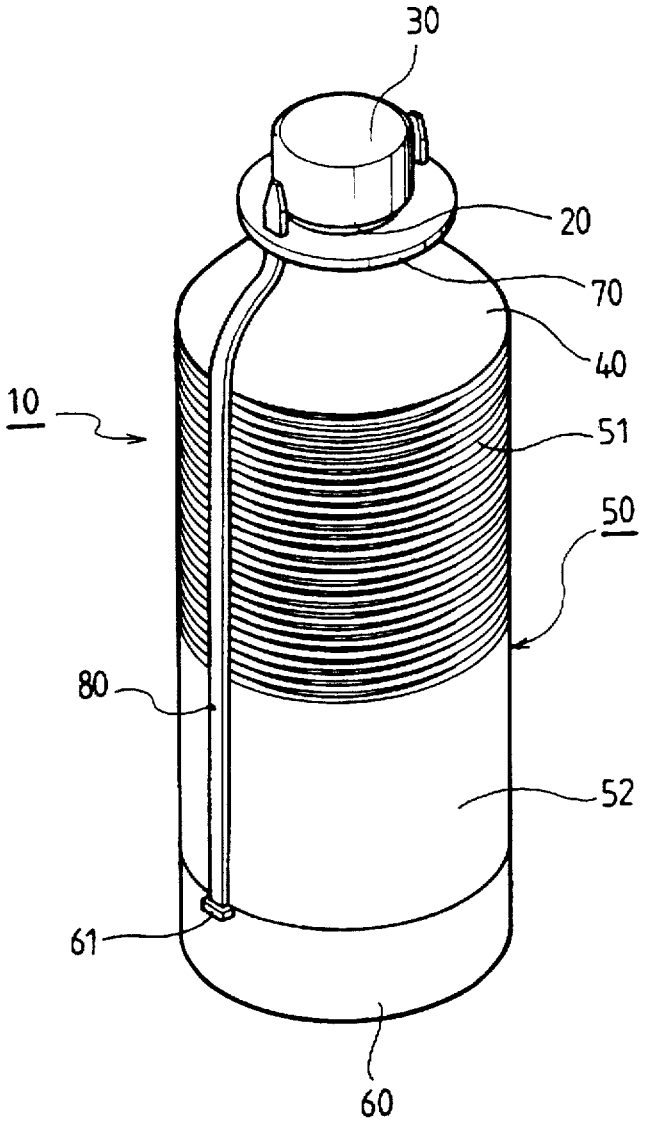
FIG. 1 is a perspective view showing the configuration of a carbonated beverage bottle in accordance with an embodiment of the present invention.
Figure 2A:
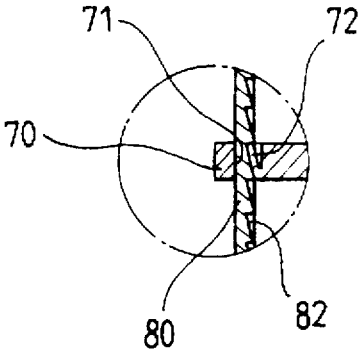
FIG. 2 is a sectional view showing the construction of the bottle of FIG. 1 and FIGS. 2*a* and 2*b* are enlarged details showing the strip fasteners.
Figure 2:
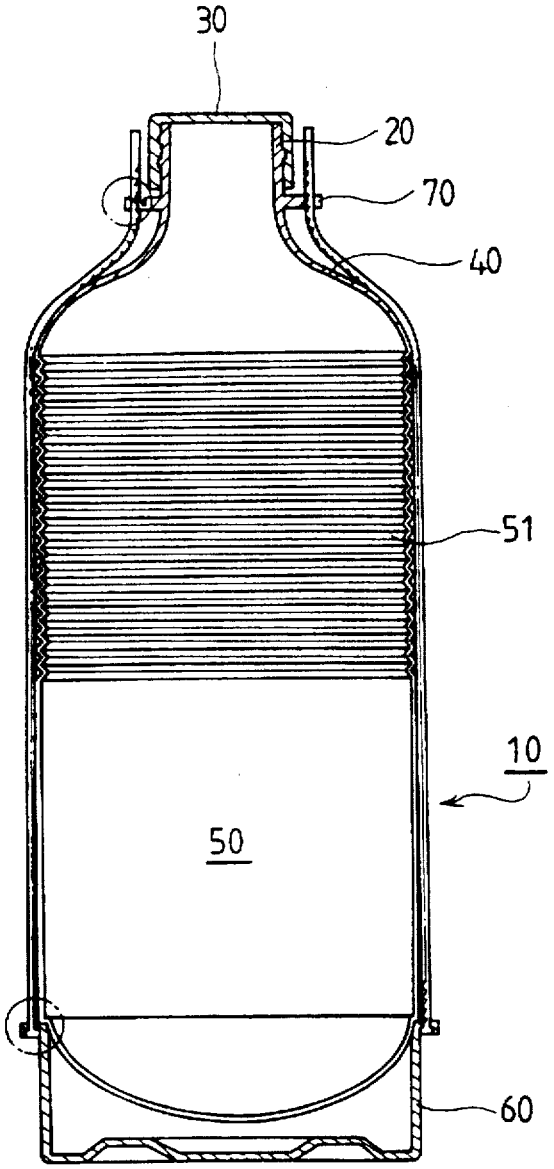

FIGS. 1 and 2 show the configuration and construction of a carbonated beverage bottle in accordance with a primary embodiment of the present invention.

As shown in the drawings, the bottle 10 of this invention comprises the outer-threaded neck 20, shoulder 40, cylindrical body 50, bottle stand 60, annular neck flange 70, and inner-threaded cap 30. In the above bottle 10, the outer-threaded neck 20 forms the mouth of the bottle 10 and engages with the inner-threaded cap 30 in order to keep the bottle 10 covered. The shoulder 40 extends from the neck 20 to the cylindrical body 50 and has a rounded conical configuration. The body 50 has a cylindrical configuration and is filled with a carbonated beverage. The stand 60 is separately formed of a relatively hard material and mounted to the bottom of the body 50. The neck flange 70, which is formed on the junction between the neck 20 and the shoulder 40, not only allows a user to easily hold the bottle 10, it also regulates the dispersing of the beverage when pouring the bottled beverage. The above-mentioned construction of the bottle 10 is the same as a conventional bottle.

Figure 2B:
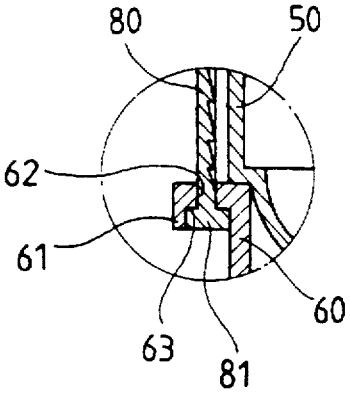

In accordance with the present invention, the bottle 10 has a bellows 51 which is formed on the body 50 at least partially. In order to selectively compress the bellows 51 and thereby reduce the volume of the bottle 10, at least two strip fasteners 80 are coupled to the bottle 10. The bottle 10 also includes a fastener holding means which couples the fasteners 80 to the bottle 10 in a way such that the fasteners 80 can be stretched up in order to compress the bellows 51 and reduce the volume of the bottle 10. In the primary embodiment, the fastener holding means comprises a plurality of, preferably, two lock slits 71 with respective elastic pawls 72 therein, see FIG. 2*a*. The lock slits 71 are formed on appropriate positions of the above annular neck flange 70 in a way such that the slits 71 are spaced out at regular intervals. It is preferable to form the two lock slits 71 on diametrically opposite positions of the neck flange 70. The fastener holding means also comprises a plurality of, preferably, two strip holding protrusions 61 which are formed on the top edge of the bottle stand 60 at positions corresponding to the above lock slits 71. Each protrusion 61 is partially depressed on the bottom surface thereof to form a stop depression 63 and is holed to form a passing slit 62, see FIG. 2*b*. The stand 60 and protrusions 61 are preferably cast as a single structure. The detailed construction of the above slits 71 and protrusions 61 according to the primary embodiment are shown in FIGS. 2*a* and 2*b*. The bottle 10 includes two strip fasteners 80 as described above. Each strip fastener 80, having a stop flange 81 on its bottom and a ratchet 82 on its longitudinal inside surface, cooperates with each lock slit 71 and an associated protrusion 61 in order to selectively compress the bellows 51 and reduce the volume of the bottle 10. In this case, each fastener 80 passes upward through the holed protrusion 61 until the stop flange 81 of the fastener 80 is tightly seated in and stopped by the stop depression 63 of the protrusion 61. The upper strip portion of the fastener 80 in turn passes upward through the lock slit 71 of the neck flange 70, so that the ratchet 82 of the fastener 80 is caught by the pawl 72 inside the slit 71.

That is, the bottle 10 of the invention is characterized in that the bellows 51 is formed on the cylindrical body 50 and is selectively compressed by the strip fasteners 80, thereby reducing the volume of the bottle 10. Due to the strip fasteners 80, the adjusted volume of the bottle 10 is prevented from being expanded, even when the carbonated acid gas resulting from vaporization of the dissolved carbonic dioxide in the beverage fills the empty space inside the bottle 10. The interior of the bottle 10 is thus highly pressurized, so that the dissolved carbonated dioxide in the beverage is prevented from vaporizing and vanishing into carbonic acid gas ultimately, thus maintaining the cool and fresh taste of the beverage for a lengthy period of time when drinking the beverage sparingly. In order to couple the strip fasteners 80 to the bottle 10, the bottle 10 has a fastener holding means. In the primary embodiment, the fastener holding means includes at least two lock slits 71 which are formed on the neck flange 70 in the junction between the neck 20 and shoulder 40 of the bottle 10. In each lock slit 71, the elastic pawl 72 is formed on the side wall and is opened upward, see FIG. 2*a*. In addition, at least two protrusions 61, each having the stop depression 63 and slit 62, are integrally formed on the top edge of the bottle stand 60 at positions corresponding to the respective slits 71. The strip fasteners 80, each having the stop flange 81 and ratchet 82, are coupled to the respective lock slits 71 and protrusions 61.

In the above embodiment, the bellows 51 is partially formed on the cylindrical body 50 of the bottle 10, so that the body 50 is divided into two parts, that is, the bellows 51 and smooth surface part 52. However, it should be understood that the bellows 51 may be formed on all of the body 50. The body 50 in the above case is free from the smooth surface part 52

Figure 4A:
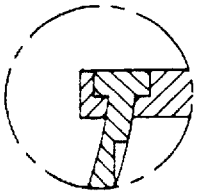
FIG. 4 is a sectional view showing the bottle of FIG. 1 and FIGS. 4*a* and 4*b* are enlarged details of another embodiment of the strip fasteners.
Figure 4:
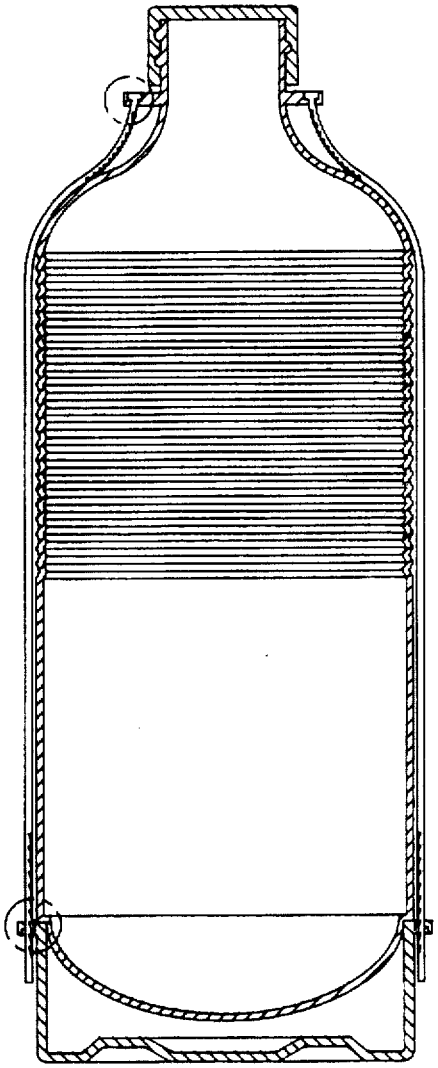
Figure 4B:
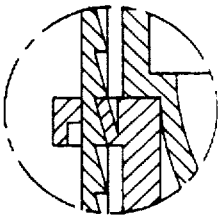

In the bottle 10 according to the primary embodiment, each lock slit 71 with the elastic pawl 72 is formed on the neck flange 70, while each protrusion 61 with the passing slit 62 and stop depression 63 is formed on the top edge of the bottle stand 60. Therefore, each strip fastener 80 passes upward through an associated protrusion 61 and in turn passes through an associated lock slit 71 when coupling the fasteners 80 to the bottle 10. However, it should be understood that the neck flange 70 may have at least two passing slits with respective stop depressions instead of the lock slits 71, while the stand 60 may have at least two lock slits with respective elastic pawls instead of the protrusions 61, see FIGS. 4*a* and 4*b*. In the above case, the configuration and construction of the passing slits and lock slits are the same as described for the primary embodiment. When the passing slits and lock slits are formed on the flange 70 and stand 60, respectively, the strip fasteners 80 will pass downward through the passing slits of the flange 70 and in turn pass downward through the lock slits of the stand 60 when coupling the fasteners 80 to the bottle 10.

Figure 3:
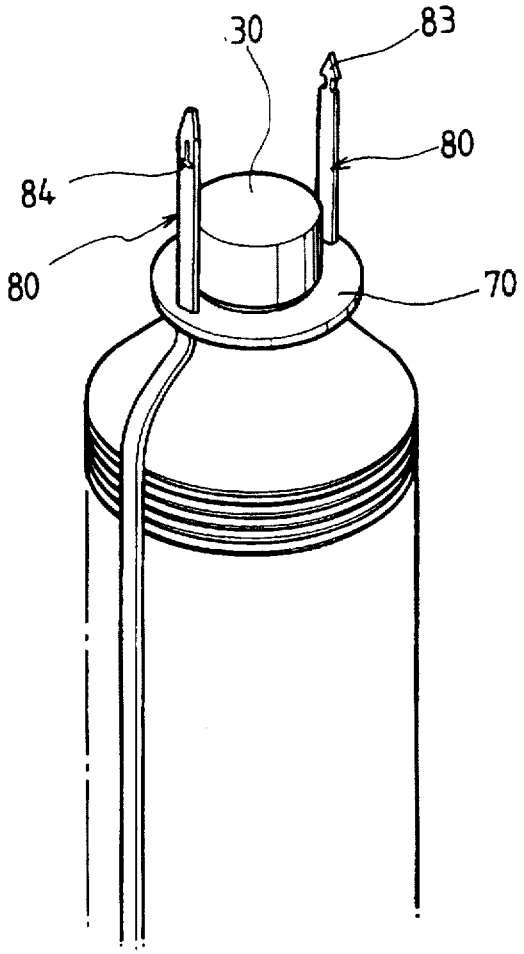
FIG. 3 is a perspective view showing the configuration of a bottle with a handle in accordance with another embodiment of the present invention.

FIG. 3 shows the configuration of a bottle in accordance with another embodiment of the present invention. In the bottle according to the above embodiment, the free end portion of one strip fastener 80 has a notched male hook 83, while the free end portion of the other fastener 80 has a female hook hole 84. The notched hook 83 is selectively coupled to the hook hole 84, thus forming a handle for the bottle 10.

In the present invention, it is preferable to somewhat enlarge the width of the neck flange 70 in comparison with the flange provided on a typical carbonated beverage bottle. Due to the neck flange 70 with the enlarged outer diameter, it is easy to form the lock slits 71 or the passing slits on the flange 70.

In addition, the height of the bellows 51 or the ratio of the bellows 51 to the smooth surface part 52 in the bottle 10 may be freely controlled in accordance with the size, structural strength and production process of the bottle 10, preference of users, drinking frequency of the bottled beverage and the amount of beverage poured from the bottle at a time.

The operational effect of the above bottle 10 will be described hereinbelow.

When some quantity of carbonated beverage is poured from the bottle 10 after opening the cap 30, an empty space remains in the bottle 10 of this invention. After some quantity of beverage has been poured from the bottle 10, the top of the bottle 10 is manually pressed down by one hand while stretching up the strip fasteners 80 by the other hand, thus compressing the bellows 51 until the surface of the beverage remaining in the bottle 10 reaches the uppermost part of the shoulder 40. Thereafter, the cap 30 is screwed on the neck 20 of the bottle 10 in order to keep the bottle 10 covered. As the bellows 51 of the body 50 is compressed to allow the surface of the remaining beverage to reach the uppermost part of the shoulder 40, only a small empty space remains in the bottle 10. In addition, the remaining empty space inside the bottle 10 is highly pressurized in the same manner as a new bottle. Therefore, the dissolved carbonic dioxide of the remaining beverage inside the bottle 10 is prevented from vaporizing and vanishing into carbonic acid gas, so that the remaining beverage maintains the intrinsic cool and fresh taste thereof for a lengthy period of time.

That is, when the top of the bottle 10 is manually pressed down by one hand while stretching up the strip fasteners 80 by the other hand after pouring some quantity of beverage from the bottle 10, the stop flange 81 of each of the fasteners 80 is tightly seated in and stopped by the stop depression 63 of an associated protrusion 61. In the above state, the upper ratchet portion of each fastener 80 continuously passes upward through an associated lock slit 71 in order to compress the bellows 51 until the stretching force is removed from the fasteners 80. When the stretching force is removed from the fasteners 80, the ratchet 82 of each fastener 80 is stably caught by the elastic pawl 72 of an associated lock slit 71, thus maintaining the compressed configuration of the bellows 51.

When opening the cap of a new bottle and pouring some quantity of beverage from the bottle, the pressure inside the bottle is quickly reduced to the atmospheric pressure. In the above state, an empty space remains in the bottle and is filled with air, so that the dissolved carbonic dioxide in the beverage in the bottle may vaporize and vanish into carbonic acid gas. However, the volume of the bottle 10 of this invention can be reduced by compressing the bellows 51, so that the high pressure inside the bottle 10 can be maintained while drinking the bottled beverage sparingly. That is, when the top of the bottle 10 of this invention is pressed down while stretching up the fasteners 80 prior to closing the cap 30, the surface of the beverage remaining in the bottle 10 reaches the uppermost part of the shoulder 40 with a small empty space remaining in the bottle 10. The dissolved carbonic dioxide in the beverage thus vaporizes into carbonic acid gas which will fill the empty space inside the bottle 10 and may expand the empty space by extending the bellows 51. However, the upper and lower sections of the bottle 10 are caught by the tightened strip fasteners 80, so that the expansion of the bellows 51 is prevented. The pressure inside the bottle 10 is thus increased, while the volume of the empty space in the bottle 10 is not expanded. Due to the high pressure inside the empty space, vaporization of the dissolved carbonic dioxide into carbonic acid gas is stopped. The highly-pressurized empty space in the bottle 10 prevents the bottled carbonated beverage from losing its cool and fresh taste.

As described above, the present invention provides a bottle for carbonated beverages which is provided with a bellows cooperating with at least two strip fasteners. When drinking the bottled carbonated beverage sparingly, the top of the bottle is pressed down while stretching up the fasteners in order to allow the surface of the remaining beverage to reach the uppermost part of the shoulder in the bottle prior to screwing the cap on the neck of the bottle after pouring some quantity of beverage. Only a small empty space thus remains in the bottle. In the above bottle, the dissolved carbonic dioxide in the beverage vaporizes into carbonic acid gas. The carbonic acid gas fills the empty space inside the bottle and may expand the empty space by extending the bellows. However, the extension of the bellows is prevented by the strip fasteners. The pressure inside the bottle is thus increased, so that vaporization of the dissolved carbonic dioxide into carbonic acid gas is stopped. The bottle thus maintains the cool and fresh taste of a bottled carbonated beverage for a lengthy period of time when drinking the beverage sparingly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bottle for carbonated beverage comprising a neck, shoulder extending from said neck, a body extending from said shoulder, a bottle stand mounted to the bottom of said body in order to hold said bottle, an annular neck flange provided in the junction between said neck and shoulder, and a cap screwed on said neck, wherein the improvement comprises:

a bellows formed on said body;

at least two strip fasteners coupled to said bottle and adapted for selectively compressing the bellows and restricting expansion of the compressed bellows and thereby reducing the volume of said bottle, each fastener having a stop flange on its bottom and a ratchet on its longitudinal inside surface; and fastener holding means for holding said stop flange of each strip fastener and engaging with said ratchet of the fastener and thereby coupling the fastener to the bottle in a way such that the fastener can be stretched up in order to compress the bellows and reduce the volume of the bottle.

2. The bottle according to claim 1, wherein said fastener holding means comprises:

a lock slit formed on said annular neck flange and being provided with an elastic pawl for engaging with said ratchet of the fastener; and a protrusion formed on said stand at a position corresponding to said lock slit, said protrusion being holed to have a passing slit and being depressed on its bottom to have a stop depression for seating and holding said stop flange of the fastener.

3. The bottle according to claim 1, wherein said fastener holding means comprises:

a lock slit formed on said stand and provided with an elastic pawl for engaging with said ratchet of the fastener; and a passing slit formed on said neck flange at a position corresponding to said lock slit, said passing slit being depressed on its top edge to have a stop depression for seating and holding said stop flange of the fastener.

4. The bottle according to claim 1, wherein a free end portion of one strip fastener has a notched male hook, while a free end portion of the other fastener has a female hook hole, said hook being selectively coupled to said hook hole so as to form a handle for the bottle.

* * * * *